United States Patent [19]

Hixon

[11] Patent Number: 5,052,645

[45] Date of Patent: Oct. 1, 1991

[54] GLOBAL POSITIONING POLE

[76] Inventor: Timothy R. Hixon, 1410 So. Summitview Dr., Fort Collins, Colo. 80524

[21] Appl. No.: 502,120

[22] Filed: Mar. 28, 1990

[51] Int. Cl.[5] ..... H01Q 1/00

[52] U.S. Cl. ..... 248/125; 343/883; 52/118; 248/542; 248/188.5

[58] Field of Search ..... 248/125, 157, 161, 188.5, 248/188.2, 186, 542; 182/18, 40, 62.5, 141; 52/67, 105, 118; 343/878, 875, 883, 880; 212/267, 265, 230

[56] References Cited

U.S. PATENT DOCUMENTS

| | | | |
|---|---|---|---|
| 1,852,925 | 4/1932 | Gomery | 248/125 X |
| 2,367,196 | 1/1945 | Butler | 343/901 X |
| 3,495,370 | 2/1970 | Habro et al. | 52/118 X |
| 4,048,638 | 9/1977 | Cejka | 343/901 X |
| 4,151,534 | 4/1979 | Bond | 343/883 |
| 4,176,360 | 11/1979 | Leavy et al. | 343/883 |
| 4,408,943 | 11/1983 | McTamaney et al. | 406/12 X |
| 4,785,309 | 11/1988 | Gremillion | 343/901 X |

FOREIGN PATENT DOCUMENTS

| | | | |
|---|---|---|---|
| 289091 | 6/1953 | Switzerland | 248/542 |

*Primary Examiner*—Karen J. Chotkowski
*Attorney, Agent, or Firm*—Dean P. Edmundson

[57] ABSTRACT

A telescoping pole system is described which is useful for supporting an antenna, for example, in an elevated position. The pole system can also be used to support a prism. The pole system is collapsible and portable. The uppermost pole section can be aligned with the lowermost pole section.

16 Claims, 2 Drawing Sheets

FIG. 2
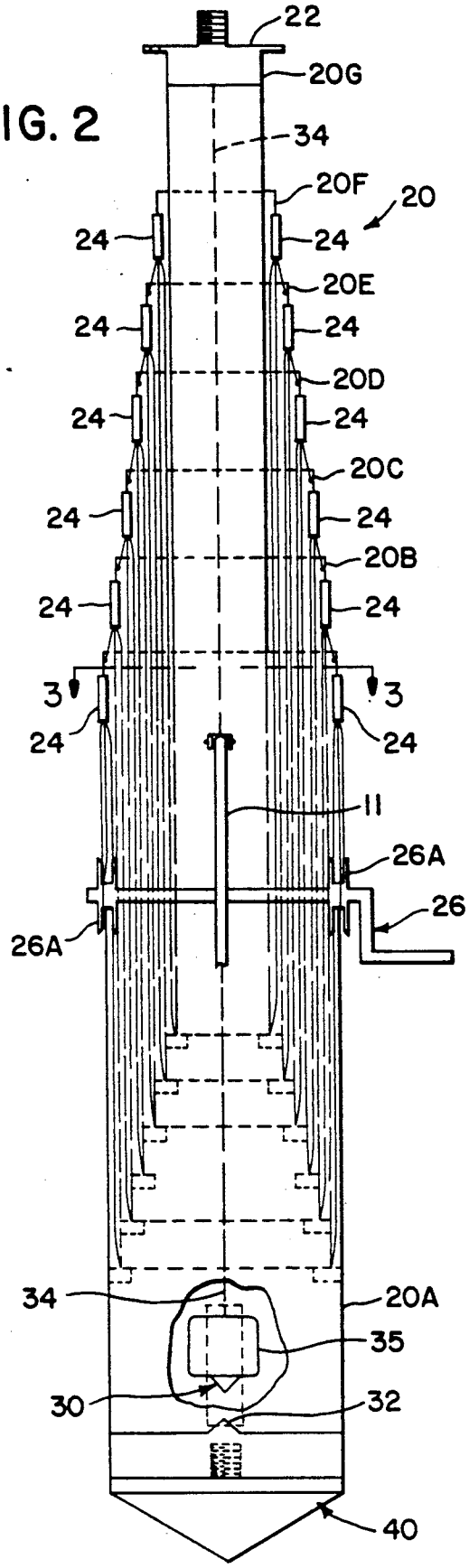
FIG. 4
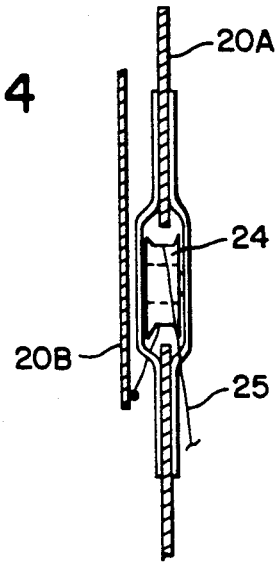
FIG. 5
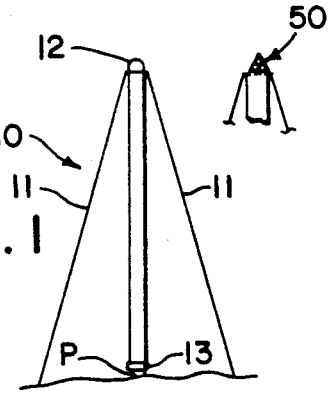
FIG. 1
FIG. 6
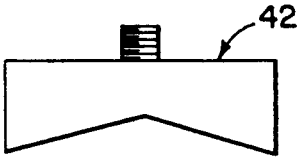

GLOBAL POSITIONING POLE

FIELD OF THE INVENTION

This invention relates to Global Positioning Systems (GPS). More particularly, this invention relates to telescoping pole systems which have a variety of purposes.

BACKGROUND OF THE INVENTION

In some mapping and surveying systems and techniques a satellite is used for transmitting a signal, and a pole is precisely positioned over a fixed point on the surface of the Earth. An antenna is supported at the top of the pole. A pole is used in order to position the antenna at an elevated height to reduce the effects of obstructions to satellite signals by hills, trees, buildings, etc.

Also in conventional surveying techniques it is often necessary to position a pole over a fixed point which is being used as a point of reference. For example, sometimes the reference point is not visible at ground level.

SUMMARY OF THE PRESENT INVENTION

In accordance with the present invention there is provided a telescoping pole system comprising:

(a) a plurality of telescoping pole sections each having upper and lower ends; each said pole section being tubular;

(b) elevating means for elevating said pole sections;

(c) indicating means for indicating alignment of said upper end of the upper most pole section with the lower end of the lowermost pole section; and (d) anchor means for supporting said pole system in an upright manner.

One of the main advantages of the telescoping pole system of this invention is that it is able to support a GPS receiving antenna in an elevated position of known height directly over a defined point of reference in a manner such that nearby obstructions (e.g., trees, buildings, etc.) cannot block or interfere with a radio signal being transmitted to the antenna. The height to which the pole may be extended may vary as desired (e.g., from 15 feet to 60 feet, as an example). The pole can be securely anchored so that it is stable.

The telescoping pole system can also be used in Electronic Distance Meter (EDM) systems as a mount for a conventional prism. The height to which the pole may be extended may vary as needed in order to support the prism at an appropriate height so as to clear obstructions.

Other advantages of the telescoping pole system of the invention will become apparent from the following detailed description and the appended drawings.

BRIEF DESCRIPTION OF THE DRAWINGS

The invention is described in more detail hereinafter with reference to the accompanying drawings, wherein like reference characters refer to the same parts throughout the several views and in which:

FIG. 1 is a side, elevational view of one embodiment of telescoping pole system of the invention;

FIG. 2 is a front elevational view, partially cut-away, of one embodiment of telescoping pole system of the invention;

FIG. 4 is a front view, partially cut-away, showing one of the pulleys used in the elevating system for the telescoping pole system;

FIG. 5 illustrates another telescoping pole supporting a prism;

FIG. 6 is a side elevational view showing another type of base which may be secured to the lower end of the pole system.

DETAILED DESCRIPTION OF THE INVENTION

In FIG. 1 there is illustrated one embodiment of telescoping pole system 10 which is held in an upright manner by means of anchors or wires 11. An antenna 12 is supported at the top of the pole system. The base 13 of the pole is supported on a fixed point P (e.g., a brass cap or section marker).

The antenna used in the GPS system acts as the satellite receiver. The telescoping pole system expedites and facilitates the transmitting and receiving process by supporting the antenna at an elevated height so that the signal to be received by the antenna is not obstructed by trees, buildings, etc.

Figure 2A:
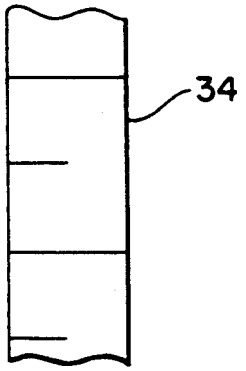
FIG. 2A is an elevational view illustrating one embodiment of flexible strip member with distance graduations for signifying the height to which the pole system has been extended.
Figure 3:
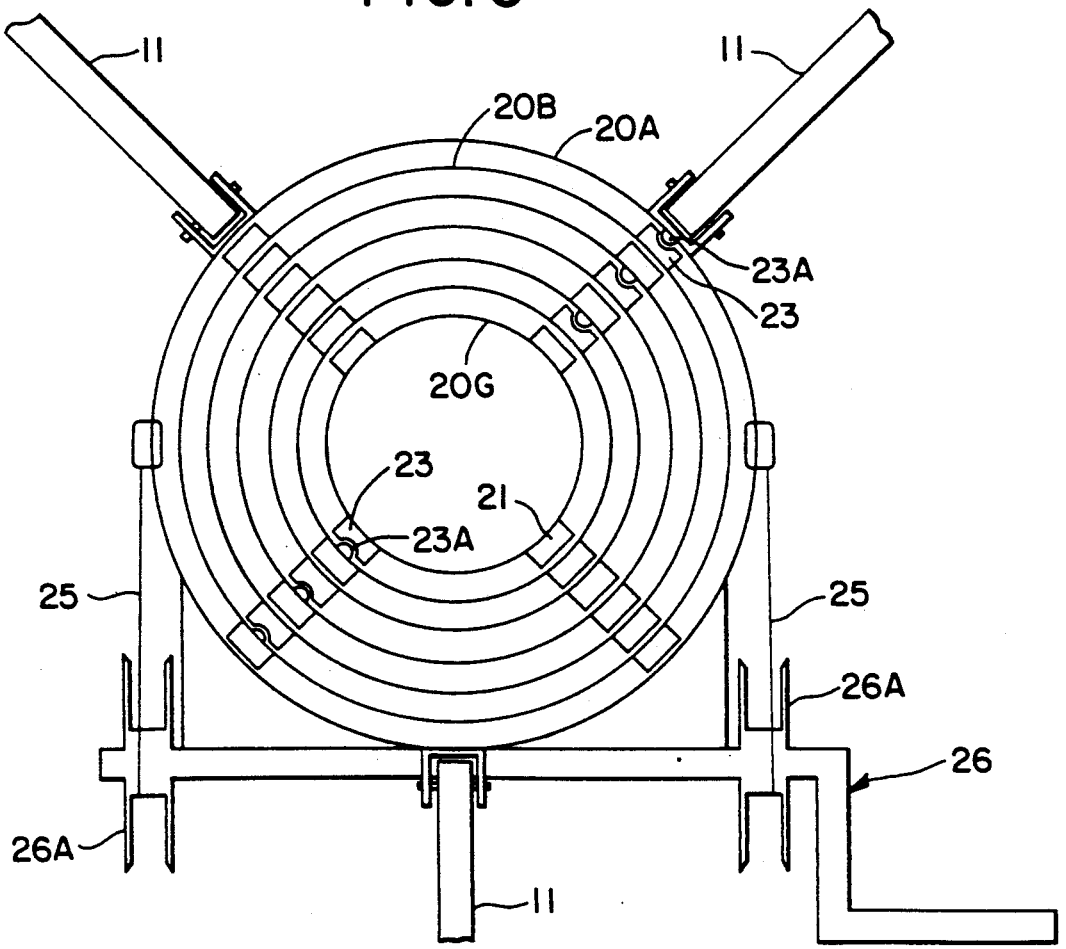
FIG. 3 is a cross-sectional view of the telescoping pole system shown in FIG. 2 taken along line 3—3.

FIG. 2 is a front elevational view, partially cutaway, of a preferred embodiment of telescoping pole system 20 of the invention. A cross-sectional view is shown in FIG. 3. The pole system includes a plurality of telescoping tubular sections 20A through 20G. The lowermost section is identified as 20A and the uppermost section is identified as 20G. A threaded support member 22 is secured to the top of the uppermost section for attachment of an antenna, prism, etc. to the pole system.

The length and diameter of the pole sections may vary. Generally speaking, the length of each pole section is in the range of about 5 to 10 feet. The diameter may vary, depending upon the type of material used, the weight of the material, the wall thickness, etc. Generally, the diameter of the lowermost section (which is the largest) is in the range of about 5 to 10 inches.

The number of telescoping sections may also vary. Generally, the number of sections used in the range of about four to ten for pole systems which are intended to reach to heights of about 25 to 60 feet.

The number and size of the individual sections of the pole system will be dependent upon the user's needs. For example, if the pole system is intended for use in brushy areas or where there is moderate vegetation, the pole may only have to be extended to a height of 25 feet or less. On the other hand, if the pole system is intended for use in forested areas, the pole may have to be extended to a height of 50 or 60 feet.

The pole sections are typically composed of metal (e.g., aluminum), fiberglass, or the like. Composite materials could also be used, if desired.

The cross-sectional configuration of the pole sections may be circular, oval, triangular, square, hexagonal, etc. Square or triangular tubing is preferred.

As shown in the drawings, the several pole sections decrease in diameter from the lowermost section to the uppermost section so that the sections can be telescoped together (either partially or completely).

The elevating means for raising the telescoped pole sections involves a plurality of pulleys. As shown in FIGS. 2 and 4, a pulley 24 is rotatably carried at or near the upper end of all of the telescoping pole sections (except for the uppermost section). Preferably there is a pulley on two opposite side walls of each pole section, as illustrated.

A cord or cable 25 extends over each pulley. One end of each cable is secured to the lower end of one pole section and the opposite end is secured to the top of the next adjacent pole section of larger diameter. The one exception is that the cable secured to the lower end of section 20B is secured at its opposite end to crank system 26.

As crank 26 is rotated, the cable 25 secured to it is wound around the drum 26A (on each side of the pole). This causes pole section 20B to be raised or elevated relative to pole section 20A. As this happens, the cable secured to the upper end of section 20A (which passes over the pulley 24 carried by section 20B) causes section 20C to be raised or elevated. In like manner, all of the other pole sections are raised or elevated at the same time. The pole is telescoped or retracted by rotating the crank in the opposite direction.

Suspended from the uppermost section 20G of the pole section is a pointer 30 which may be, for example, a plumb bob. The pointer is weighted so that gravity pulls it downwardly at all times. The weighted pointer is suspended from a cord, cable or band 34 secured at its upper end to the upper end of pole section 20G, as illustrated.

Another pointer member 32 is carried or supported by the base of pole section 20A. When the upper pointer 30 is in alignment with the lower pointer 32, this indicates that the uppermost section of the pole system is in proper vertical alignment with the base of the lowermost pole section. In other words, alignment of the two pointers assures that whatever is mounted to the top of the pole system (e.g., an antenna or prism) is directly above the base of the pole system.

The base 40 of the pole system may be resting on a brass cap section marker or other fixed point on the surface of the Earth. An alternative type of base 42 is illustrated in FIG. 6. Base member 40 is pointed or conical in shape whereas base member 42 is concave or an inverted cone. The base member includes a threaded post to enable it to be easily threaded onto the lower end of the lowermost pole section and removed again when desired.

Preferably the cable or band 34 from which the weighted pointer 30 is suspended comprises a flat strip (See FIG. 2A) which has graduations on it (e.g., inches or centimeters) to indicate the distance from the top of the pole to the bottom thereof. Even more preferably, the strip is adapted to retract into a housing or enclosure 35 as the pole system is retracted or collapsed (i.e., analogous to a tape measure retracting into a housing or enclosure). A spring or other bias means within the housing operates to draw the strip into the housing when the pole is retracted.

Graduation marks on the strip are necessary in order to accurately measure the height of the pole directly below the antenna (or prism) where elevation is determined. The strip 34 is retractable into the housing 35 so as to ease the operation and to prevent the strip from being tangled or damaged.

As illustrated in FIG. 3, there are spacers 21 and 23 between adjacent pole sections. These spacers assist in maintaining alignment of the pole sections and reduce wobbling. Spacers 23 include a concave or indented face on one side to accept a curved rib or tongue carried by the facing wall of an adjacent pole section. This prevents one section from rotating relative to an adjacent section.

FIG. 5 illustrates a prism 50 supported on the top of a telescoping pole system of the invention. Prisms are used with electronic measuring systems commonly referred to as EDMs (Electronic Distance Meters). These EDMs transmit a radio, infrared, or laser beam which is reflected by the prism back to the EDM. The electronics inside the EDM then calculate the distance to the prism. These prisms are used with all current EDM systems, just as antennas are used with satellites in all current GPS systems.

Figure 7:
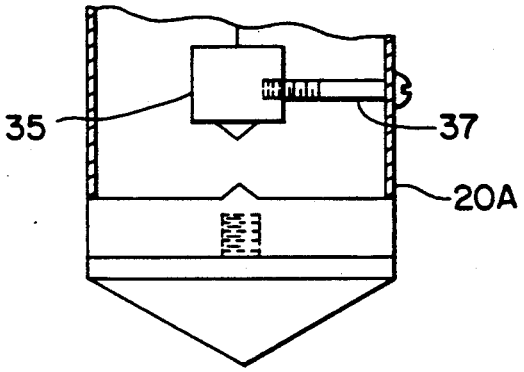
FIG. 7 is a side elevational cutaway view illustrating another feature of the present invention.

FIG. 7 illustrates another variation of the pole system of the invention in which the plummet or housing 35 is secured by means of threaded screw 37 to pole section 20A. This prevents the plummet from moving during transport and storage. Screw 37 is removed to free plummet 35 at the time the pole system is used for its intended purpose.

Other means or systems may be used to secure the plummet during transport and storage. For example, other retainer means such as clips or wedges, or foam padding, etc. may be used, if desired. This avoids the need to remove the plummet for transport and storage.

Other variants of the invention are possible without departing from the intended scope thereof.

What is claimed is:

1. Telescoping global positioning pole system comprising:
   (a) a plurality of telescoping pole sections each having upper and lower ends; each said pole section being tubular;
   (b) elevating means for elevating said pole sections;
   (c) indicating means for indicating alignment of said upper end of the upper most pole section with the lower end of the lowermost pole section; wherein said indicating means comprises a first alignment member supported by said uppermost pole section and a second alignment member supported by said lowermost pole section; and
   (d) anchor means for supporting said pole system in an upright manner.

2. A pole system in accordance with claim 1, wherein said indicating means comprises first and second pointers, wherein said first pointer is suspended from said uppermost pole section by means of a flexible strip member; and wherein said second pointer is supported by said lowermost pole section.

3. A pole system in accordance with claim 2, wherein said flexible strip member includes distance graduations for signifying the height to which the pole system has been extended.

4. A pole system in accordance with claim 1, wherein said anchor means comprises wires secured at one end to said lowermost pole section.

5. A pole system in accordance with claim 1, wherein said elevating means comprising:
   (a) a plurality of rotatable pulleys carried by said plurality of pole sections:
   (b) a plurality of flexible cables each having first and second ends; wherein a said cable extends over a said pulley; wherein said first end of each said cable is attached to one said pole section and said second end of each said cable is attached to an adjacent said pole section;

(c) a crank rotatably supported by said lowermost pole system; wherein the second end of one of said cables is secured to said crank;

wherein rotation of said crank causes all of said pole sections to be elevated with respect to said lowermost pole section.

6. A pole system in accordance with claim 5, wherein there are two of said pulleys carried by the upper end of each said pole section except said uppermost pole section.

7. A pole system in accordance with claim 6, further including an antenna detachably supported on said upper end of said uppermost pole section.

8. A pole section in accordance with claim 6, further including a prism detachably supported on said upper end of said uppermost pole section.

9. A pole section in accordance with claim 2, further including retention means for retaining and supporting said first pointer when said pole system is in collapsed position for transport.

10. Telescoping pole system comprising:

(a) a plurality of telescoping pole sections each having upper and lower ends; each said pole section being tubular;

(b) elevating means for elevating said pole sections;

(c) indicating means for indicating alignment of said upper end of the upper most pole section with the lower end of the lowermost pole section; wherein said indicating means comprises first and second pointers, wherein said first pointer is suspended from said uppermost pole section by means of a flexible strip member; and wherein said second pointer is supported by said lowermost pole section; and (d) anchor means for supporting said pole system in an upright manner.

11. A pole system in accordance with claim 10, wherein said flexible strip member includes distance graduations for signifying the height to which the pole system has been extended; and wherein said anchor means comprises wires secured at one end to said lowermost pole section.

12. A pole system in accordance with claim 10, wherein said elevating means comprising:

(a) a plurality of rotatable pulleys carried by said plurality of pole sections:

(b) a plurality of flexible cables each having first and second ends; wherein a said cable extends over a said pulley; wherein said first end of each said cable is attached to one said pole section and said second end of each said cable is attached to an adjacent said pole section;

(c) a crank rotatably supported by said lowermost pole system; wherein the second end of one of said cables is secured to said crank;

wherein rotation of said crank causes all of said pole sections to be elevated with respect to said lowermost pole section.

13. A pole system in accordance with claim 12, wherein there are two of said pulleys carried by the upper end of each said pole section except said uppermost pole section.

14. A pole system in accordance with claim 13, further including an antenna detachably supported on said upper end of said uppermost pole section.

15. A pole section in accordance with claim 13, further including a prism detachably supported on said upper end of said uppermost pole section.

16. A pole section in accordance with claim 10, further including retention means for retaining and supporting said first pointer when said pole system is in collapsed position for transport.

* * * * *